US007077703B2

(12) United States Patent
Herlitz et al.

(10) Patent No.: US 7,077,703 B2
(45) Date of Patent: Jul. 18, 2006

(54) PLUG CONNECTOR

(75) Inventors: Martin Herlitz, Remscheid (DE); Peter Paul Schekalla, Wuppertal (DE)

(73) Assignee: Delphi Technologies, Inc, Troy, MI (US)

( * ) Notice: Subject to any disclaimer, the term of this patent is extended or adjusted under 35 U.S.C. 154(b) by 0 days.

(21) Appl. No.: 10/855,152

(22) Filed: May 27, 2004

(65) Prior Publication Data

US 2004/0248467 A1 Dec. 9, 2004

(30) Foreign Application Priority Data

Jun. 3, 2003 (EP) ..... 03012603

(51) Int. Cl.
*H01R 13/648* (2006.01)

(52) U.S. Cl. ..... 439/607; 439/354; 439/856

(58) Field of Classification Search ..... 439/607–610, 439/465, 135, 137, 140, 141, 144, 147, 345, 439/350, 352–358, 856
See application file for complete search history.

(56) References Cited

U.S. PATENT DOCUMENTS 4,797,116 A * 1/1989 Isohata et al. ..... 439/141
4,810,210 A 3/1989 Komatsu
4,900,262 A 2/1990 Matsuzaki
5,035,652 A 7/1991 Shibano
5,167,516 A * 12/1992 Tan et al. ..... 439/141
5,171,161 A 12/1992 Kachlic
5,244,415 A * 9/1993 Marsilio et al. ..... 439/610
5,545,052 A 8/1996 Hirai
5,634,809 A 6/1997 Hirai
6,007,381 A 12/1999 Ando et al.
6,116,914 A * 9/2000 Koide ..... 439/63
6,146,205 A * 11/2000 Lai ..... 439/610
6,165,017 A * 12/2000 Kuo ..... 439/610
6,431,887 B1 8/2002 Yeomans et al.
2002/0151205 A1 10/2002 Huetter et al.

FOREIGN PATENT DOCUMENTS

EP 0224200 B1 6/1987
EP 0562311 B1 9/1993
EP 0601265 B1 6/1994
EP 0738029 B1 10/1996
EP 1028496 A2 8/2000

* cited by examiner

*Primary Examiner*—James R. Harvey
(74) *Attorney, Agent, or Firm*—David P. Wood

(57) ABSTRACT

A plug connector for plugging together with a complementary plug connector in a plugging direction, in particular for use in a motor vehicle, comprises a contact element receiver for receiving a contact element, preferably at least two contact elements, a screen which at least partly surrounds the contact element receiver and a housing which at least partly accommodates the contact element receiver and the screen.

17 Claims, 6 Drawing Sheets

PLUG CONNECTOR

Figure 1:
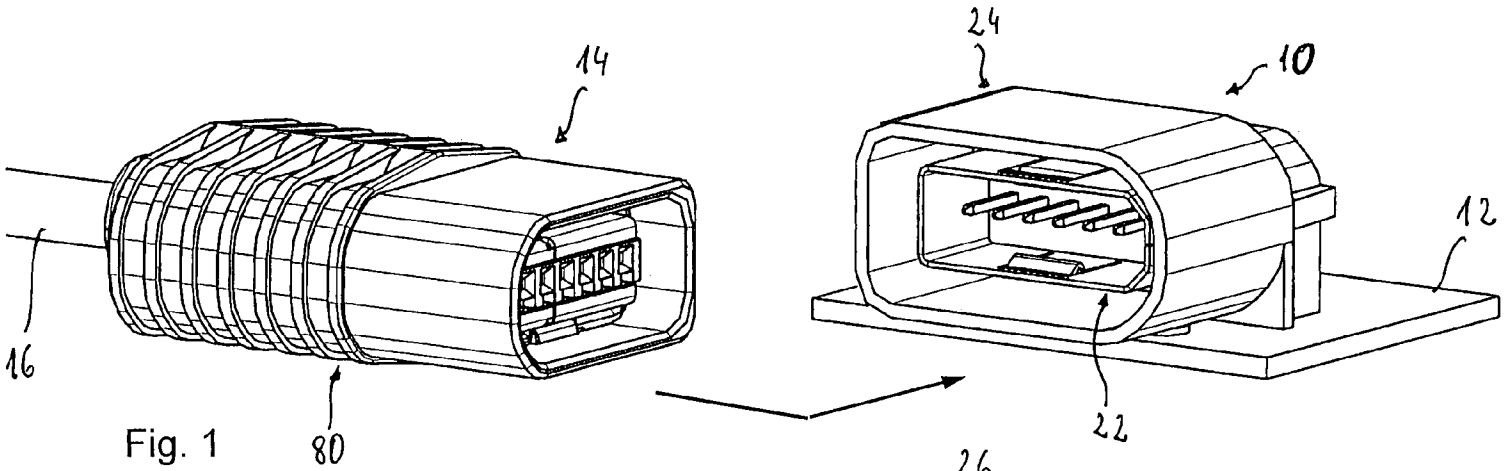

The present invention relates to a plug connector for plugging together with a complementary plug connector, in particular for use in a motor vehicle.

Plug connectors are used to connect leads electrically as well as mechanically in a simple manner to another lead or to a circuit carrier with an electrical circuit. Plug connectors are therefore in particular also used in the construction of motor vehicles. In this field of application, plug connectors of this kind must, on the one hand, be economical to manufacture and, on the other hand, permit a stable connection even under unfavourable conditions of use, in particular in the presence of vibrations and/or shocks.

Digital data connections are also increasingly being used in motor vehicles in addition to analog data connections for the transmission of control signals or data. In order to reduce interference in the data transmission by other electrical or electronic devices, in particular by electromagnetic radiation which is emitted by the latter, it is desirable to use screened electrical connectors for the data transmission in the automotive field as well.

The object on which the present invention is based is therefore to provide a simple plug connector by means of which low interference connections to a circuit carrier or to screened leads can be established in a simple manner.

This object is satisfied by the plug connector having the features of claim 1.

The plug connector in accordance with the invention for plugging together with a complementary plug connector in a plugging direction, in particular for use in a motor vehicle, has a contact element receiver for receiving a contact element, preferably at least two contact elements, a screen which at least partly surrounds the contact element receiver and a housing which at least partly receives the contact element receiver and the screen.

The plug connector in accordance with the invention has a contact element receiver for receiving contact elements. The contact element receiver, which is preferably formed as an injection molded plastic part, can have corresponding receiving passages for this purpose. The contact elements can be pushed into, pressed into or also injection molded into the contact element receiver.

The contact element receiver is preferably made to receive at least two contact elements, particularly preferably more than two contact elements. A plug connector of this kind is then suitable in particular for connecting leads of a bus system in a motor vehicle, which frequently have a plurality of wires.

In principle any desired contact elements, for example contact pins, contact tongues or contact blades or contact sleeves, can be used. The contact elements can be connected to conductors, by which not only wires of cables will be understood in the context of the invention, but also conductive tracks on circuit carriers.

The screen, which is made from an electrically conductive material, preferably from a metal, serves for the screening of contact elements in the contact element receiver against electrical and electromagnetic fields. For this purpose, it can in particular have a contacting device, to which a lead with a reference potential, for example ground, can be connected. The screen preferably accommodates the contact element receiver.

Furthermore, the screens of the plug connector and of the complementary plug connector can expediently be made such that an electrical contact is established between the screens when the plug connectors are plugged together.

The contact element receiver and the screen, which at least partly surrounds it, are at least partly surrounded by the housing, which protects them from external influences and in particular can also be formed for a mechanical connection to a complementary plug connector or to its housing. In particular the housings of the plug connector and/or of the complementary plug connector can have guides by means of which the plug connectors can be guided toward or into one another when being plugged together.

A further subject of the invention is a plug connector system comprising a first plug connector in accordance with the invention and a second plug connector in accordance with the invention which is complementary to the first plug connector and can be plugged together with it. The complementary second plug connector can for this purpose in particular have corresponding second contact elements which are arranged in a correspondingly formed contact element receiver and which are complementary to the contact elements of the first plug connector as well as a housing which permits a plugging together with the housing of the first plug connector.

The plug connectors in accordance with the invention permit a simple connection of a screened lead to another lead, in particular likewise a screened lead, or to a circuit carrier, with the contacting region being at least partly screened and thus low in interference.

Further developments and preferred embodiments of the invention are described in the description, the claims and the drawings.

The housing can in principle be constructed in any desired manner; an embodiment is, however, preferred in which the housing is assembled, in particular plugged and/or pushed together, from at least two housing parts. The housing parts, which are preferably made as plastic injection molded parts, can have securing elements for this purpose by which they are, where appropriate, movably connected to one another. In particular in a design for plugging and/or pushing together, a particularly simple connection of the housings by machine is possible. The plug connector can then be manufactured in a simple manner by fitting together the contact element receiver, the screen and the housing. In particular an injection molding of the housing onto a lead can be avoided if the latter can be surrounded by plugging together the housing parts. For this purpose, the housing parts can preferably have corresponding indentations in edge regions, which form an opening for receiving the lead only after the housing parts are fitted together. The indentations can preferably have sections of a cuff which surrounds a lead after the housing is fitted together. The lead can then be installed into the housing when the housing parts are fitted together. This can in particular be advantageous when the contact elements are to be connected to the lead prior to the assembly of the plug connector in order to enable a simple handling during the assembly. The manufacture of a plug connector of this kind as well as its connection to a lead is then particularly economical.

Alternatively, it is preferred for the housing to be formed in one piece and to comprise a sleeve-like section into which the screen is pushed with the contact element receiver. The screen with the contact element receiver is pushed with the contact element receiver into the sleeve-like section by a relative movement between the housing and the screen, so that the housing can also be pushed over the screen. A housing of this kind is particularly simple to construct and is stable. Furthermore, it can be simply manufactured by plastic injection molding. It is then particularly preferred for the housing to have a flap for at least partly closing an opening through which the screen can be pushed into the housing with the contact element receiver. The flap can, where appropriate, have an indentation in an edge region through which a lead can be introduced.

For the particularly simple manufacture of the screen, it is preferred for it to be formed from one or more bent stamped parts. The screen can thus be manufactured particularly simply and or with a full or large area.

In order to obtain as good a shielding as possible, it is preferred for the screen to surround the contact element receiver as completely as possible, in particular substantially up to the end faces of the contact element receiver on or in which parts of contact elements are arranged. In this context, substantially in particular means that small gaps or holes which are caused by the manufacture can arise at seams or corners, preferably, however, not in surfaces. It is particularly preferred for the screen also to surround ends of contact elements arranged in the contact element receiver which protrude from the contact element receiver on the plugging side of the latter.

In an embodiment, it is preferred for the screen to have two screen parts which can be displaced transversely to the plugging direction and which are preferably formed as bent stamped parts. It is particularly preferred for the screen to have only two screen parts. The screen parts are preferably pushed over the contact element receiver. The screen parts can also have complementary securing elements, by means of which they can be connected to one another. In this way a screen can be very simply provided even for contact element receivers which do not permit a simple pushing on of a screen in the plugging direction or do so only with additional work steps.

It is particularly preferred for the contact element receiver and the screen to have cooperating blocking elements which extend transversely to the plugging direction and which block a relative movement between the contact element receiver and the screen in and/or opposite to the plugging direction. These blocking elements can in particular be a groove and a corresponding strip or mutually abutting projections. In this way, with a simple manufacturability of the screen, a relative movement between the screen and the contact element receiver can be reliably prevented even when larger plugging forces arise on the contact elements and thus on the contact element receiver.

Alternatively, it is preferred for the screen to be formed in one piece as a bent stamped part. Screens of this kind are distinguished not only by a particularly simple and economical manufacture, but also permit a simple manufacture of the plug connector, since there is only one part to be handled.

It is furthermore preferred for the screen to have a bent over wing which is angled with respect to the plugging direction and which at least partly closes a push-in opening in the screen through which the contact element receiver can be pushed into the screen. On the one hand, a good screening even of a push in opening of this kind is hereby achieved. On the other hand, a relative movement between the contact element receiver and the screen opposite to the plugging direction is prevented, since this is blocked by the bent over wing. The contact element receiver can thus not be pushed back out of the screen by plugging forces during the plugging together with another plug connector. Screens of this kind are preferably used with contact element receivers which are made for receiving contact elements, the lead-side ends of which are angled with respect to the plugging direction. For example they, as well as the contact element receiver, can be formed substantially in L-shape. The bent over wing can then be angled in particular at an angle of approximately 90° with respect to the plugging direction. A screen of this kind can simply be pushed onto the contact element receiver or, respectively, the contact element receiver can be pushed into the screen, prior to a bending of the wing out of a position which is preferably oriented parallel to the plugging direction, whereupon the wing is bent over onto the contact element receiver. In this way, a good screening with a very simple manufacturability results even with angled contact elements. A wing can accordingly also be used for contact element receivers which receive linear contact elements and can in particular have an opening or preferably an indentation in its edge through which cables can be led to contact elements in the contact element receiver. In principle, a plurality of wings can also be used for closing the push-in opening.

It is particularly preferred for holding elements to be formed on the wing which preferably extend in the plugging direction in the bent over state and for corresponding complementary holding elements to be formed in the housing by means of which the bent over wing can be secured relative to the housing in a direction which is inclined with respect to the plugging direction. The holding elements and the complementary holding elements are expediently formed such that the screen can be pushed with the bent over wing into the housing or the housing can be pushed onto the screen with the bent over wing. In particular, grooves or slits which extend parallel to the plugging direction in conjunction with corresponding projections, strips or springs can be used as holding elements. In this way, the wing can simply be pushed into the housing, with a later bending over of the wing being blocked at the same time. The bent over wing can then take up plugging forces which are in particular exerted on the wing via the contact element receiver and transmit them to the housing.

Furthermore, it is particularly preferred for the plug connector to be made as an appliance receiver, with contacts for connecting to a circuit carrier preferably being made on opposite sides of the screen. The contacts of the screen preferably serve for the mechanical connection to the circuit carrier and at the same time for the electrical connection to conductive tracks on the circuit carrier. Furthermore, the housing can expediently have additional securing elements, for example spigots, by means of which it can be connected to the circuit carrier, so that it can, for example, transmit forces easily to the circuit carrier which arise on plugging together with a complementary plug connector. The contact element receiver as well as the contact elements can preferably be formed in L-shape, so that the plugging direction can extend parallel to a circuit carrier on which the appliance receiver is then held.

In order to reduce the risk that an established plug connection is, for example, accidentally released by vibrations and/or shocks, it is preferred for the screen to have at least one securing element, preferably a snap element or latching element, which, when the plug connector is plugged together with a corresponding complementary plug connector, can be moved relative to a complementary securing element of the complementary plug connector, preferably a complementary snap element or latching element, into a securing position relative to the complementary securing element and by means of which a relative movement of the plug connectors out of the plugged together state can be limited in the securing position through cooperation with the complementary securing element. The complementary plug connector can in particular be made as a suitably formed plug connector in accordance with the invention, in particular in accordance with any one of the claims 1 to 8, having a corresponding complementary securing element. One of the securing elements is at least partly movable, preferably in a direction which deviates from the plugging direction. The plug connector and the complementary plug connector are therefore securable, which means movable apart only by overcoming forces which are determined by the securing elements, at least in a predetermined range of positions in a plugged together state in which the contact elements and the complementary contact elements are still in contact with one another. The securing elements can in particular be made such that a relative movement of the plug connectors out of the plugged together position is blocked. The securing elements can furthermore provide a contact in the securing position between the screens of the plugged together plug connectors when the complementary securing element is likewise made on the screen of the complementary plug connector. The use of snap elements or latching elements has the advantage that they can automatically snap in or latch in to one another when the securing position is reached to form a snap connection or latching connection respectively, so that the securing can take place automatically.

In order to be able to enable a particularly stable securing of the plug connection between the plug connector and a suitable complementary plug connector, it is preferred for the screen to have two securing elements which are preferably formed at oppositely disposed sides of the screen. These can in each case be formed alike or differently. In particular in an arrangement at oppositely disposed sides of the screen, arising forces can be better distributed. Moreover, an additional security results from the redundancy which is achieved.

In an embodiment of the plug connector in accordance with the invention it is preferred for the securing element to have a resilient snap hook or latching hook which is preferably formed in a collar which is formed by the screen. The resilient snap hook or latching hook can in particular be formed by a spring arm with a snap projection or latching projection respectively arranged at its free end. The screen is then preferably manufactured from a correspondingly elastic metal sheet. If the snap hook or latching hook is formed in a collar formed by the screen, the collar preferably surrounds contact elements which protrude out of the contact element receiver so that they are mechanically protected before and during the plugging together and are electromagnetically easily screened after the plugging together.

Furthermore, it is preferred for the securing element to have a securing projection, behind which a snap hook or latching hook of a complementary plug connector plugged together with the plug connector engages in the securing position. The complementary plug connector can be formed in accordance with the invention and in particular in accordance with the embodiment which is described in the preceding paragraph and/or with claim 11. A securing element or snap element or latching element respectively of this kind is therefore complementary to a securing element formed as a snap hook or a latching hook. The securing projection can in particular be formed by a shoulder of a cut-out or recess in the screen of the plug connector.

In particular on the use of snap elements or latching elements as securing elements it is not completely excluded that the securing elements move out of the securing position relative to one another in the presence of correspondingly strong shocks or vibrations and thus, as a result, a release of the plug connection is not blocked. It is therefore preferred for a latching element movable relative to the contact element receiver between an unlatching position and a latching position to be provided, with the securing elements of the plug connector and of the complementary plug connector being movable into the securing position and/or out of the securing position in the unlatching position of the latching element and with the latching element latching the securing elements in their securing position against a movement out of the securing position in the latching position. The complementary plug connector can be formed in accordance with the invention and in particular in accordance with one or more of the above described embodiments and/or with one of the claims 1 to 12.

In order to enable a particularly compact plug connection it is preferred for the latching element to be displaceable relative to the screen parallel to the plugging direction and preferably to surround the screen at least partly in the manner of a sleeve. A design as a sleeve is advantageous in particular when two securing elements formed at oppositely disposed sides of the screen are provided, since then both securing elements can be latched or unlatched at the same time with only one latching element.

In principle it is sufficient for the latching element to be movable into the latching position by hand. It is, however preferred, for a resilient element to be provided which can be urged into the unlatching position by movement of the latching element relative to the plug connector and for the latching element to be movable into the latching position by means of the restoring force of the resilient element. In this way, an automatic latching can be achieved and it can in particular be largely prevented that a latching fails to take place through an assembly error. Moreover, the manufacture of the plug connector is simplified.

It is particularly preferred for the resilient element to be formed by a spring arranged in the plugging direction. It can in particular be arranged between a projection or an abutment of the latching element and a support element at the housing, at the contact element receiver or preferably at the screen. In an arrangement at the screen, the plug connector in accordance with the invention is particularly simple to manufacture if the housing is assembled last.

If a plug connector in particular in accordance with the invention with a snap hook or a latching hook as a securing element is used as the complementary plug connector, the screen of the plug connector can have a cut-out or recess, into which, by plugging together the plug connectors, the snap hook or the latching hook of the complementary plug connector can be snapped or latched such that the latching element is at least partly movable over the snap hook or latching hook. It is then preferred for the latching element to be movable into the unlatching position by the housing, the screen or preferably the snap hook or latching hook of the complementary plug connector during the plugging together with a complementary plug connector. Not only does an automatic latching in a simple manner result in this way; but an automatic unlatching is also possible during the plugging together, so that the securing elements can reach their securing position without additional assembly manipulations. The plug connector system in accordance with the invention can in particular comprise a correspondingly made first plug connector and a complementary second plug connector in accordance with the invention, the housing, screen or preferably snap hook or latching hook of which is formed accordingly.

Plug connections must frequently also be releasable again. For this purpose, it is preferred for the latching element to be movable out of the latching position into the unlatching position by an opening movement of an actuation part of the housing out of a connection position in which the plug connector in an opening position is plugged together with a complementary plug connector relative to the contact element receiver. In the open position of the actuation element, the latching element which is at least partly coupled to the actuation element during the opening movement therefore assumes the unlatching position. The housing can have guides for this purpose, by means of which the actuation part can be guided relative to the housing between the connection position and the open position, with it being possible for the movement, for example, to be limited by corresponding abutments at the housing. The actuation part is preferably made as a sleeve which at least partly surrounds the screen, whereby a particularly compact plug connector results, in particular on a design of the latching element as a sleeve which surrounds the screen and is at least partly surrounded by the actuation part.

In principle, the actuation element can be rigidly coupled to the latching element. It is, however, preferred for the latching element to have a co-moving abutment which contacts a complementary abutment of the actuation part at least during a part of the opening movement of the actuation part. This abutment preferably also limits the movement of the latching element in the plugging direction and thus determines the latching position of the latching element. In this way the latching element can be moved out of its latching position in a simple manner during the plugging together without an opening movement of the actuation element, for example with the help of the snap hook or of the latching hook of a complementary plug connector. In particular the actuation element can be used for the plugging together. On the other hand, the plug connection can also be released simply. In particular when the latching element is held in its latching position by a spring, the force which is required for moving the latching element out of the latching position into the unlatching position can be simply but effectively determined by a corresponding design of the spring.

It is furthermore preferred for the movable securing element to be made as a snap hook which can be moved opposite to the plugging direction out of the securing position by a movement relative to the complementary snap element, that is a securing projection, when corresponding forces act. The former in particular can have a hook surface which extends at an inclination to the plugging direction and which is moved parallel to the plugging direction by corresponding compelling forces transversely to the plugging direction, sliding off along the securing projection during a moving apart of the plugged together plug connector.

In a plug connector system in accordance with the invention, it is preferred for the first plug connector to have a collar formed by the screen in which a plurality of male contact elements are at least partly arranged, and for a plurality of female contact elements to be arranged in the contact element receiver of the second plug connector, with the contact element receiver of the second plug connector being introducible with the screen into the collar of the first plug connector. In this way, a large area contact between the two screens is achieved.

In the plug connector system in accordance with the invention the first plug connector is preferably formed as an appliance receiver in accordance with the invention or as a plug coupling in accordance with the invention and the complementary second plug connector is preferably formed as a plug with a latching element.

In order to enable as reliable a connection between cables and contact elements in the plug connector as possible, it is preferred for contact elements which can be fastened or crimped to or are fastened to a cable to be arranged in the contact element receiver. The fastening of contact elements to a cable is frequently termed the establishment of a so-called crimp connection.

Figure 2:
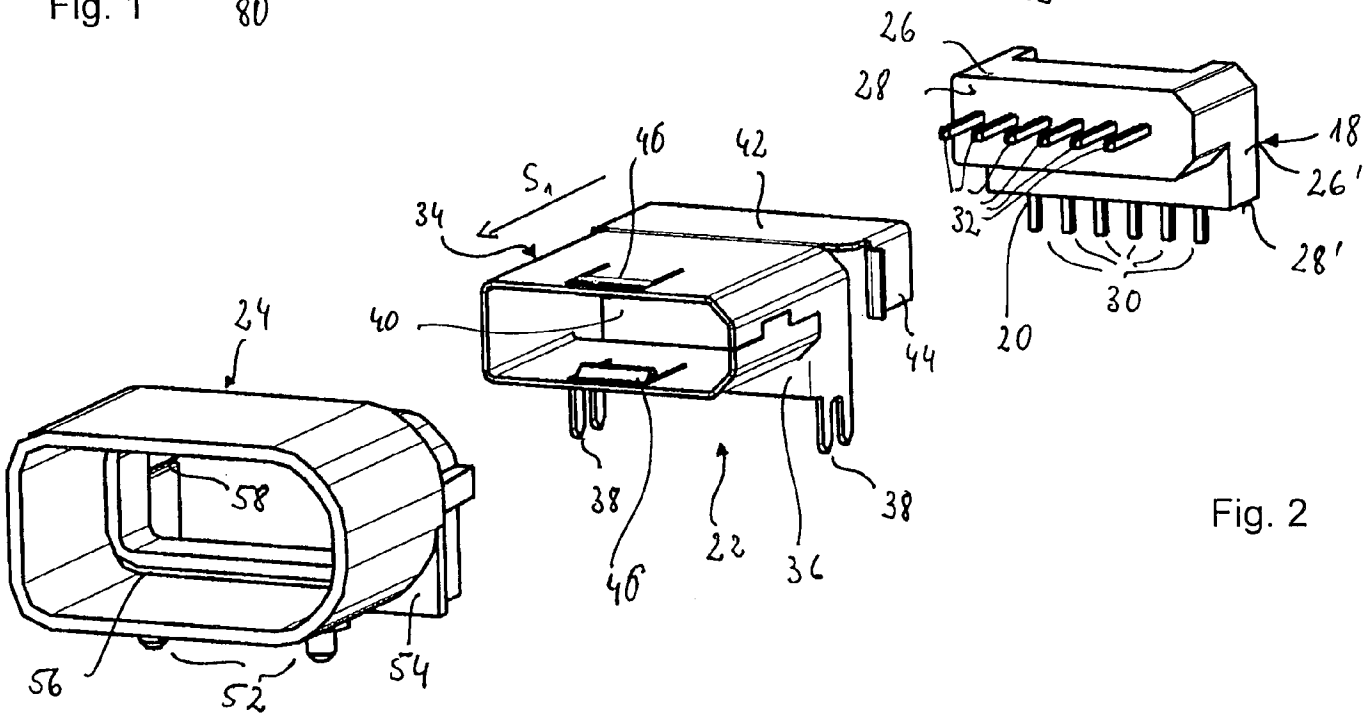
Figure 4:
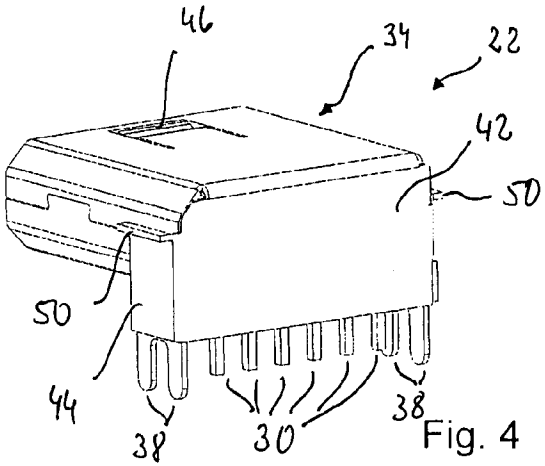
Figure 6:
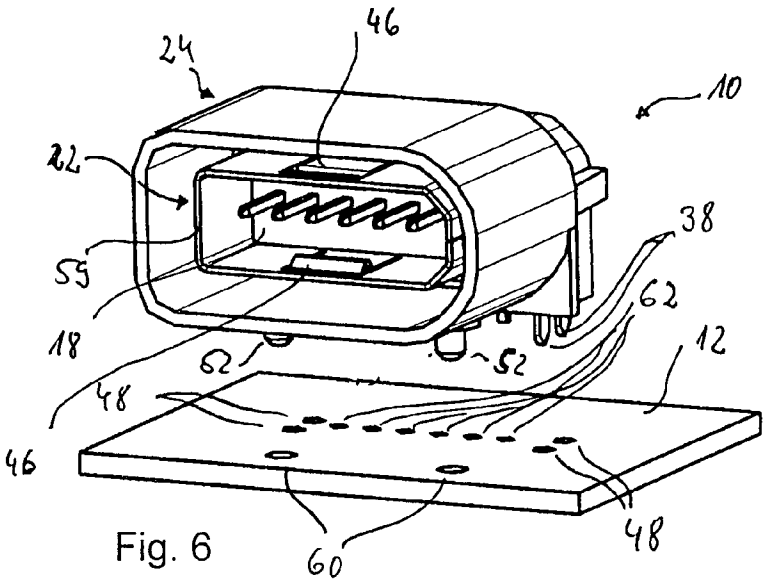
Figure 3:
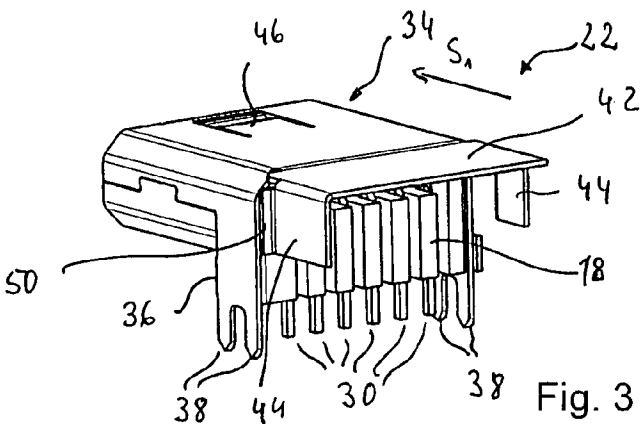
Figure 5:
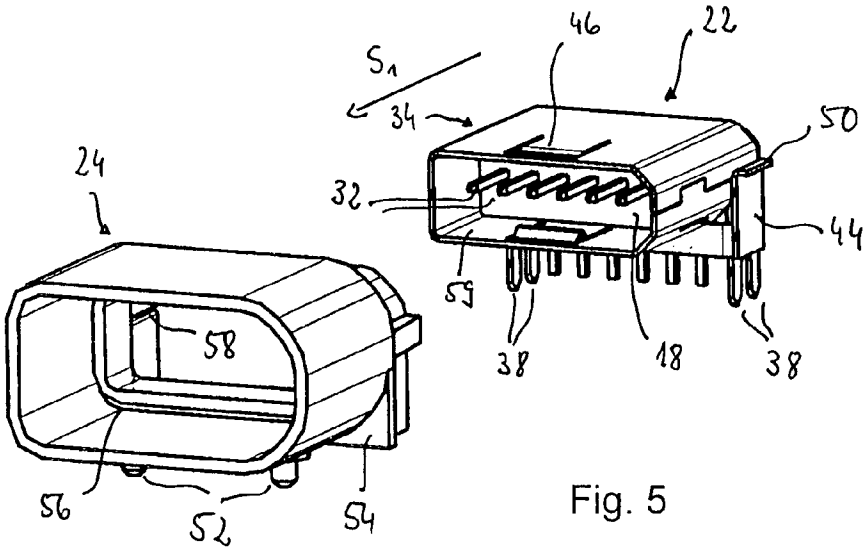
Figure 7:
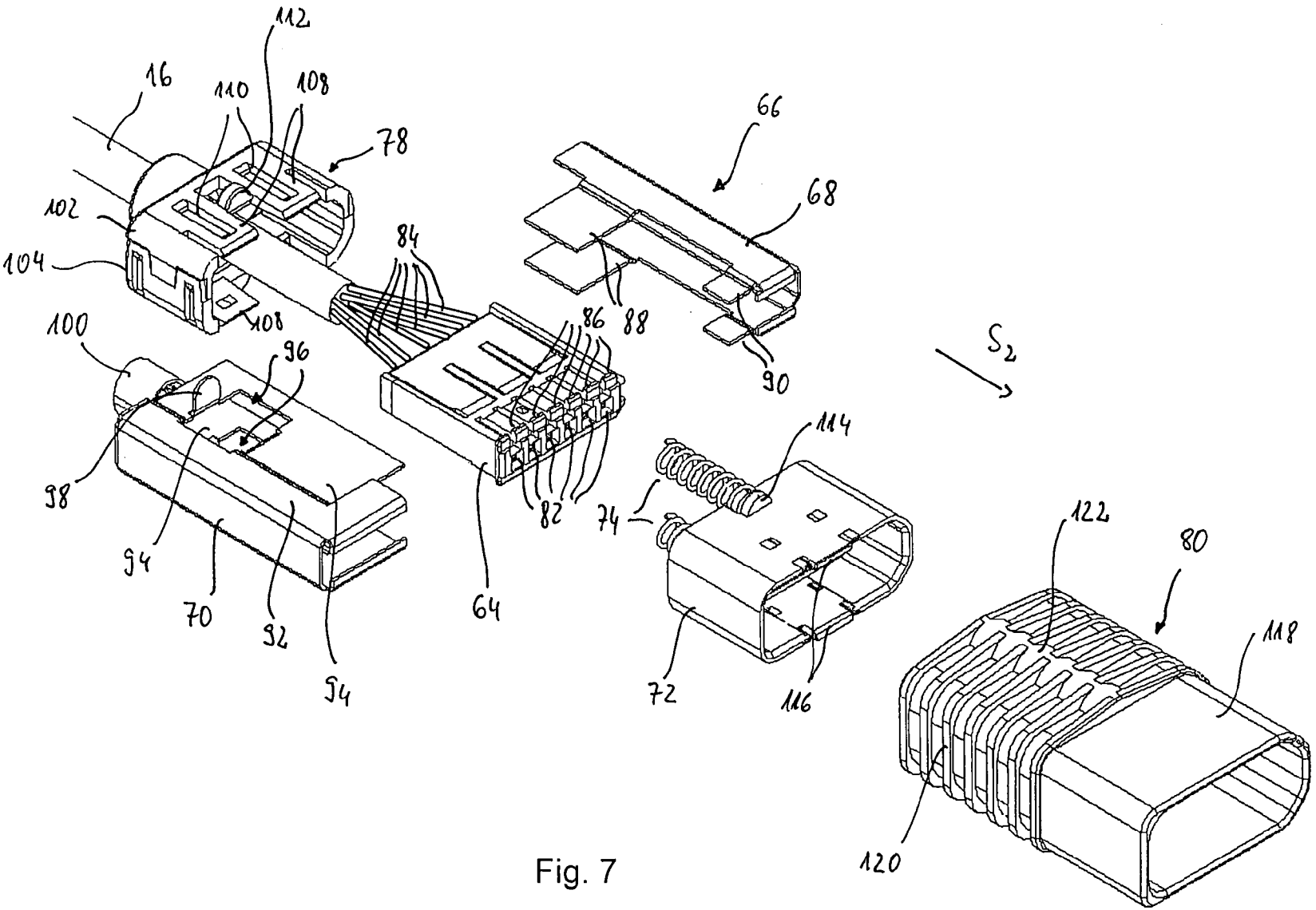
Figure 9:
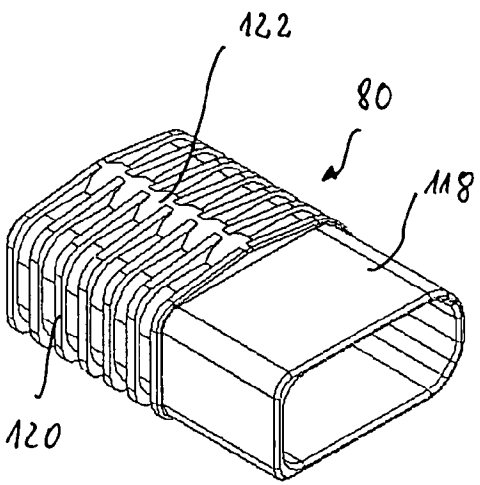
Figure 8:
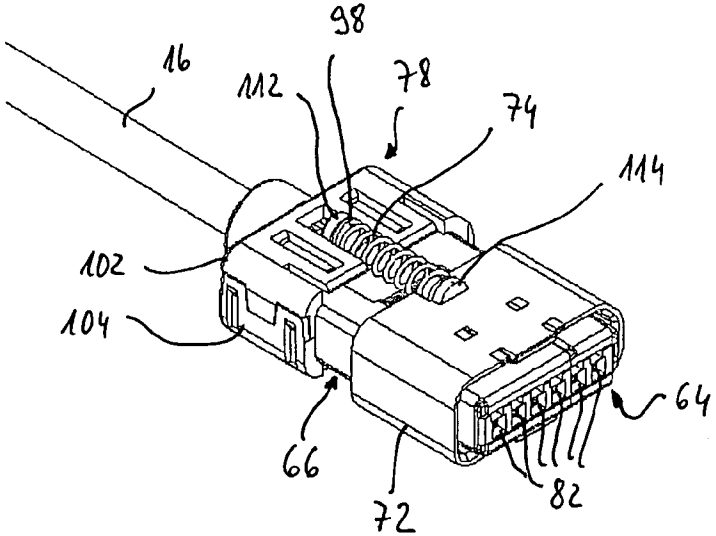
Figure 8:
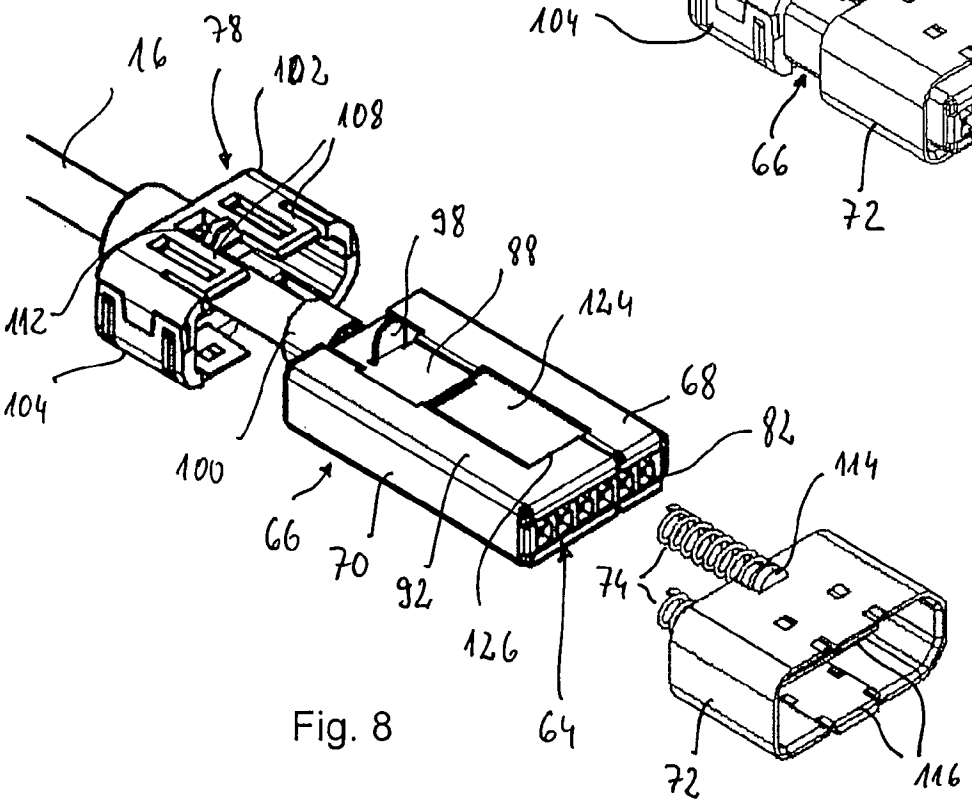
Figure 11:
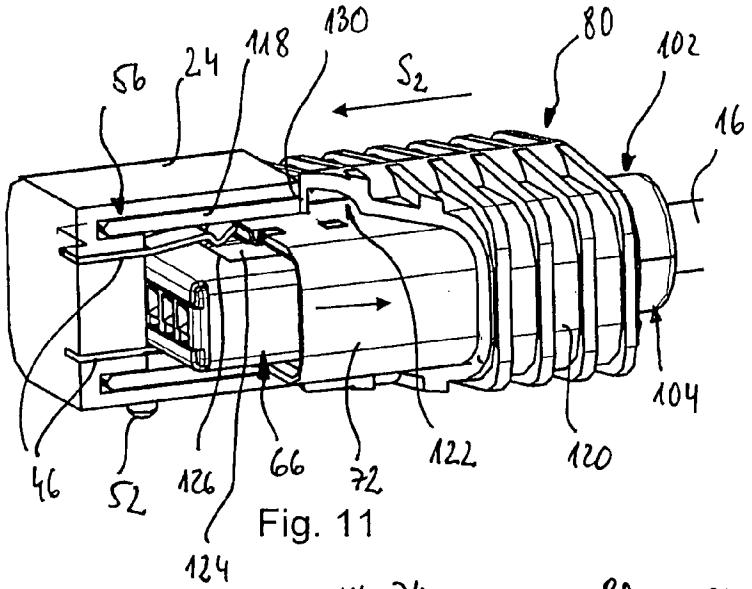
Figure 13:
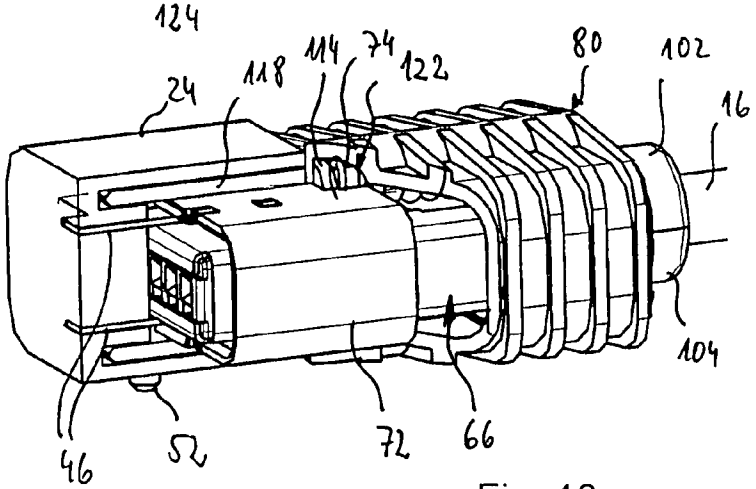
Figure 10:
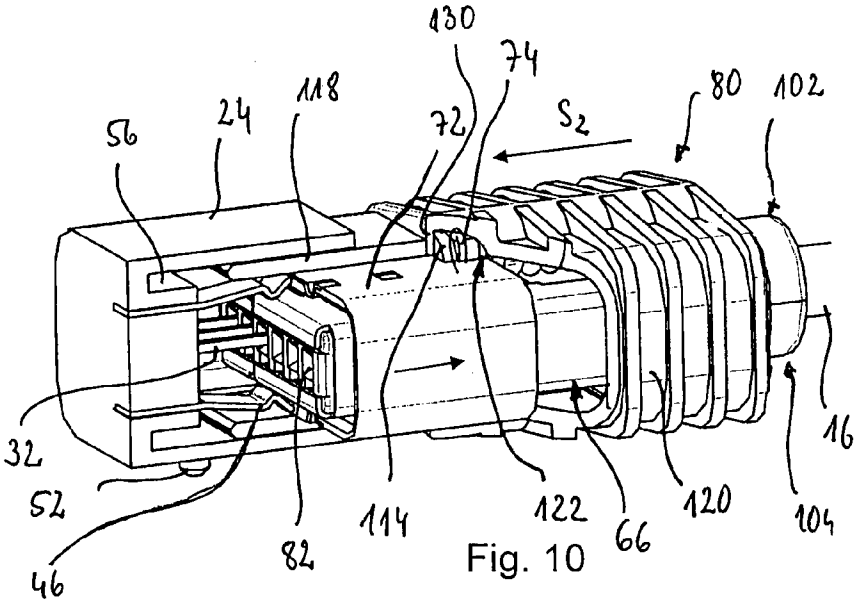
Figure 12:
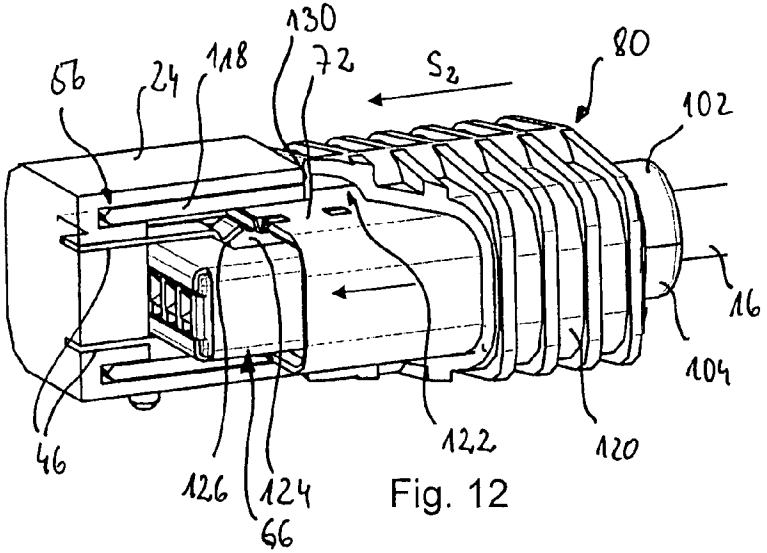
Figure 14:
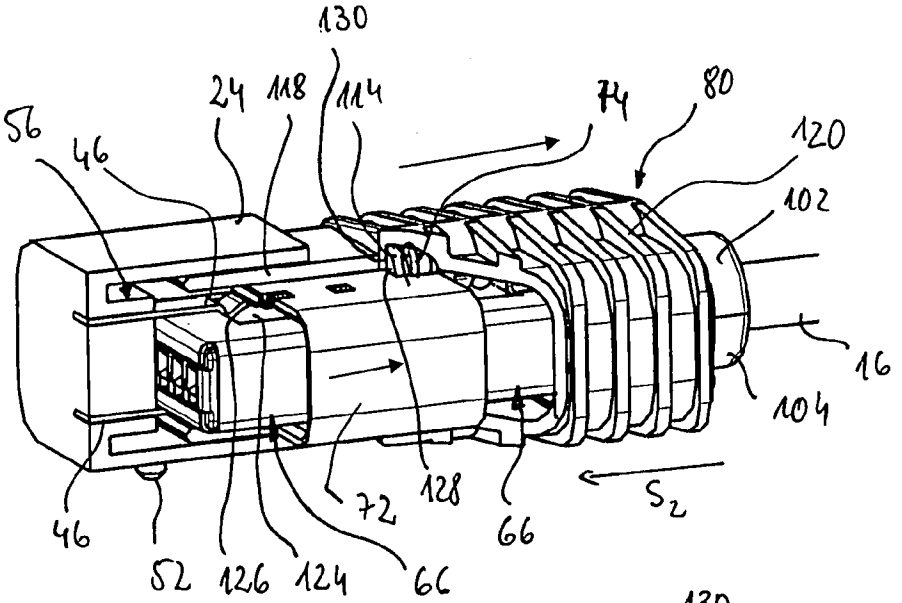
Figure 15:
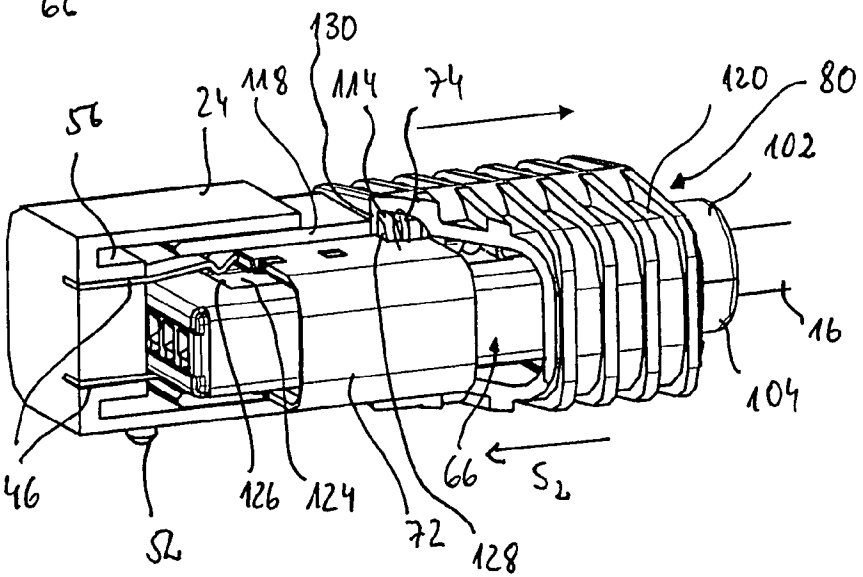

The invention will now be explained in an exemplary manner with reference to the drawings. Shown are:

FIG. 1 a schematic, perspective illustration of a plug connector system in accordance with a preferred embodiment of the invention with a first plug connector madean appliance receiver on a circuit carrier and a second plug connector which is complementary to the first in accordance with corresponding preferred embodiments of the invention, FIG. 2 a perspective explosion illustration of the first plug connector in FIG. 1, with a first screen of the first plug connector being shown in an assembly state, FIG. 3 a perspective view of the first screen in FIG. 2 in the plugging direction with a first contact element receiver with first contact elements which is pushed into the former, FIG. 4 the first screen with the pushed-first contact element receiver in FIG. 2 after the bending over of a wing of the first screen, FIG. 5 a perspective illustration of a first housing of the first plug connector in FIG. 1 and of the first screen with the first contact element receiver in FIG. 4, which is held therein, prior to the plugging together, FIG. 6 the first plug connector in FIG. 5 in the plugged together state over a section of the circuit carrier in FIG. 1, FIG. 7 a schematic exploded illustration of the second plug connector, FIG. 8 a schematic, partly exploded illustration of the second plug connector in FIG. 7 in which two screen parts of a second screen of the second plug connector are plugged together around a second contact element receiver, FIG. 9 the second plug connector in FIG. 7 in an assembly state which is complete except for the plugging on of an actuation part, FIG. 10 a partly sectioned schematic view of the first and the second plug connector during the plugging together in a first stage, FIG. 11 the view in FIG. 10 in a later, second stage of the plugging together, FIG. 12 the view in FIG. 11 in a third stage of the plugging together, FIG. 13 the view in FIG. 10 with completely plugged together first and second plug connectors, FIG. 14 the view in FIG. 13 during release of the plug connector in a first stage, and FIG. 15 the view in FIG. 14 at a later, second stage.

There are shown in Fig., a first plug connector 10 in accordance with a preferred embodiment of the invention, which is formed as an appliance receiver, on a merely partly shown circuit carrier 12 formed as a board in the example, and a plug connector 14, which is formed as a plug and which likewise embodies a preferred embodiment of the invention which corresponds to the plug connector, are shown. They form a plug connector system for a motor vehicle in accordance with a preferred embodiment of the invention. The second plug connector 14 is connected to a lead 16. It is formed as a plug connector complementary to the first plug connector 10 and can thus be plugged together with it in order to connect the cable 16 to the circuit carrier 12 and in particular to conductive tracks which are arranged thereon.

The first plug connector, that is, the appliance receiver 10, is shown more precisely in FIGS. 2 to 6. The first plug connector 10 consists of three prefabricated components which can be plugged one into the other, namely a first contact element receiver 18 with contact elements formed as contact pins 20, a first screen 22 manufactured from a metal sheet as a single-piece bent stamped part, and a first housing 24.

The first contact element receiver 18 formed as a plastic injection molded part has an L-shape with a first limb 26, which extends in a plugging direction $S_1$ and has an asymmetrical cross-section, and a second limb 26', which is angled with respect to the former at an angle of 90°. A first end face 28 of the first limb 26 is oriented orthogonally to the plugging direction $S_1$ and a second end face 28' of the second limb 26' is oriented orthogonally to the first end face 28.

The contact element receiver 18 contains, pressed into corresponding passages and grooves, a plurality of likewise L-shaped contact pins 20 which are arranged parallel to one another, in the example six contact pins 20, the conductor-side contacting ends 30 of which protrude angled with respect to the plugging direction $S_1$ at an angle of approximately 90° out of the second end face 28' of the second limb 26', with the plugging ends 32 of the contact pins 20 protruding out of the first end face 28 of the first limb 26 and extending parallel to the plugging direction $S_1$.

The single-piece first screen 22, which is stamped out of a resilient metal sheet, is shown in FIG. 2 in an already partly bent state and has a sleeve section 34 which corresponds in its shape to the corresponding section of the first contact element receiver 18. A substantially U-shaped foot part 36 with fork-like feet 38 arranged at oppositely disposed sides adjoins it and, together with the sleeve section 34, surrounds in U-shape a push-in opening 40 which is oriented orthogonally to the plugging direction $S_1$. The contact element receiver 18 can be pushed through the push-in opening 40 into the first screen 22 (cf. FIG. 3).

Furthermore, a wing 42 with side parts 44, which are shown already bent over in FIG. 2, is formed at the sleeve section 34 at the edge of the push-in opening 40 and is oriented parallel to the plugging direction in an assembly state in FIG. 2 with the exception of the side parts 44.

The sleeve section 34 and in particular its interior space have a cross-section transversely to the plugging direction which corresponds to the cross-section of the contact element receiver transversely to the plugging direction $S_1$, so that the contact element receiver 18 can be pushed into the bush section 34 lying in close contact with the inner wall of the latter.

Furthermore, two resilient snap hooks 46 which are formed by a spring arm with a hook-like section which is produced on it through bending are formed in the sleeve section 34 as securing elements. The hook-like sections are bent in V-shape with limbs which are inclined obliquely to the plugging direction $S_1$. These securing elements are arranged symmetrically with respect to one another at oppositely disposed sides of the sleeve section 34, with the sections which project in a hook-like manner pointing in each case into the interior of the sleeve section 34. The securing elements 46 serve at the same time for contacting a second screen of the second plug connector 14.

In its shape, the foot part 36 likewise corresponds to the shape of the corresponding section of the first contact element receiver 18, i.e. of the second limb 26', with the fork-like feet 38 being made for mounting in corresponding holes 48 on the circuit carrier 12.

The wing 42 is dimensioned such that by bending over of the wing 42 along a bending line orthogonal to the plugging direction $S_1$, the push-in opening 40 can be substantially covered or closed by the wing 42 (cf. FIG. 4). For this purpose, the wing 42 and the side parts 44 on it are made such that, in the bent over state, their lower edge aligns approximately with the lower edge of the foot part 36 and of the limb 26'. Furthermore, bent over guide strips 50 which extend parallel to the plugging direction $S_1$ in the bent over state in FIG. 4 are formed at the side parts 44.

The first housing 24 is formed in one piece as a sleeve-like injection molded part of a shape retaining plastic with an asymmetric cross-section transversely to the plugging direction $S_1$ which corresponds to the cross-section of the first screen 18. For securing to the circuit carrier 12, it has two holding pins 52 and a substantially U-shaped wall section 54 formed such that it takes up the foot part 36 of the screen in a substantially shape matched manner and which is seated with its lower edges on the circuit carrier 12 when secured to the latter.

A circumferential receiving groove 56 is formed in the first housing 24 for receiving a housing collar of the second plug connector 14. Furthermore, holding grooves 58 are formed parallel to the plugging direction $S_1$, which extends parallel to the walls of the sleeve-like section of the housing 24, for receiving the guide strips 50 at the side parts 44 of the wing 42 of the first screen 22.

On the assembly of the plug connector 10, after the stamping out and bending of the first screen 22 into the shape which is shown in FIG. 2 and after the manufacture of the first contact element receiver 18 with the injection molded contact pins 20, as shown in FIG. 3, the first contact element receiver 18 is pushed into the first receiver 22. The wing 42 is oriented parallel to the plugging direction $S_1$ in the assembly state. The part of the sleeve section 34 which protrudes beyond the end face 28 now forms a collar 59 which encircles the plugging ends 32 and the edge of which protrudes beyond the plugging ends 32 in the plugging direction $S_1$.

Then the wing 42 is bent over toward the first contact element receiver 18 until it lies in contact with the edge of the foot part 36 angled at an angle of approximately 90° with respect to the plugging direction $S_1$ (cf. FIG. 4). The first contact element receiver 18 is now secured against movements parallel to the plugging direction S1 by the bent over wing 42, on the one hand, and by the wall section of the foot, part 36 which is disposed oppositely to the wing 42, on the other hand. Furthermore, the first contact element receiver 18, including the plugging ends 32, is substantially completely surrounded by the first screen 18 with the exception of the end faces of the limbs 26 and 26'.

In a next step (cf. FIG. 5), the thus formed unit is pushed into the first housing 24, with the guide strips 50 being introduced at the side parts 44 into the holding grooves 58 in the first housing 24. The latter are formed in such a manner that, at least for assembly purposes, the unit consisting of the first contact element receiver 18 and the first screen 22 is connected to the housing 24 by a press fit. A bending over of the wing 42 into a position parallel to the plugging direction $S_1$ is now blocked by the guide strips 50 held in the holding groove 58, so that the first contact element receiver 18 is held securely in the first screen 22. Furthermore, the first housing 24 surrounds the sleeve section 34 of the first contact element receiver 18, so that the sleeve section is mechanically well protected.

The thus formed unit can now be mounted on the circuit carrier 12, with the feet 38 being introduced into the holes 48, the holding spigots 52 being introduced into corresponding securing holes 60 and the contacting ends 30 being introduced into contacting holes 62. In this arrangement the holding spigots 52 are seated in a press fit in the securing holes 60. The feet 38 serve both as a mechanical holder for the first screen 22 and for the contacting of conductive tracks on the circuit carrier 12. The thus very simple to manufacture first plug connector 10 in the form of an appliance receiver is then held very firmly on the circuit carrier 12 even in the presence of very large plugging forces.

The second plug connector 14 is shown more precisely in FIG. 7. It has a second contact element receiver 64, a second screen 66 with two screen parts 68 and 70, a latching element 72 with two resilient elements 74, and a housing 76 with a housing cap 78 and an actuation part 80.

The second contact element receiver 64 is likewise designed as a plastic injection molded part and has the basic shape of a shallow right parallelepiped. In the second contact element receiver 64, a plurality of passages for receiving contact elements 82 are formed parallel to a plugging direction $S_2$ of the second plug connector, in the example six passages arranged parallel to one another in a row. The contact elements 82 have contact bushes on the plugging side and devices on the conductor side for crimping on cables 84 of the lead 16, that is, for the establishment of a crimp connection to the cables 84. Blocking projections 86 are formed at the front side in the plugging direction $S_2$ as blocking elements.

The second screen 66 consists of the two screen parts 68 and 70, which are formed as bent stamped parts and which can be plugged together in a direction which is transverse to the plugging direction $S_2$. The two screen parts 68 and 70 are designed substantially in U-shape in such a manner that they surround the second contact element receiver 64 after the plugging together and lie in contact with the latter.

For connecting to the second screen part 70, the first screen part 68 has two pairs of first tongues 88 and second tongues 90 which are lowered in each case with respect to the outer surfaces.

In an L-shaped outer section 92, the second screen part 70 has mutually oppositely disposed areally indented regions 94 which protrude outwardly parallel to their surface beyond the L-shaped section 92. Furthermore, apertures 96, which correspond in their shape approximately to the shape of the first tongues 88 are in each case stamped out in the indented regions 94. Support elements 98 are in each case bent over approximately orthogonally to the plane of the indented regions 94 at the side of the apertures 96 which is oppositely disposed to the plugging direction $S_2$. Furthermore, at the end face disposed oppositely to the plugging direction $S_2$, a band clamp fitting 100 which can be bent together is formed for the contacting of a screen of the lead 16 which is not shown in the figures.

Shoulders of the L-shaped section 92 which are adjacent to the indented regions 94 form, orthogonally to the plugging direction $S_2$, securing protrusions as securing elements which are complementary to the snap hooks 46.

Like the first screen part 68, the second screen part 70 is also formed symmetrically to a plane which extends parallel to the indented region 94 except for the band clamp fitting 100.

The indented regions 94 are lowered with respect to the L-shaped section 92 to such an extent that the blocking projections 86 of the second contact element receiver 64 can be held in the end-side section of the L-shaped section 92.

The housing cap 78 is two-pieced and is plugged together from an upper part 102 and a lower part 104 and has a cuff 106 for receiving the lead 16 which is formed of corresponding cuff sections of the upper and lower part.

The housing cap 78 is substantially formed pot-like, with the pot walls being formed such that they can partly and receive the plugged together screen 66 in a shape matched manner (cf. FIG. 9).

At each of the oppositely disposed flat sides, two securing elements 108 are formed, by means of which the actuation part 80 can be held displaceably on the housing cap 78. The extent of the displacement is determined by the length of slits 110 in the securing elements 108. Furthermore, housing support elements 112 are formed on the upper part 102 and the lower part 104 which correspond in their shape to the support elements 98 at the second screen part 70 and which support the latter in the assembled state of the second plug connector.

The latching element 72 is likewise designed as a sleeve-like plastic injection molded part and corresponds in its shape substantially to the shape of the sleeve-like section of the housing cap 78. Abutment elements 114 are formed at oppositely disposed flat sides of the latching element 72 which serve, on the one hand, to hold the resilient elements 74 which are executed in the form of spiral springs and, on the other hand, to act as co-moving abutment.

Two optional slider plates 116 of metal are secured at oppositely disposed inner sides of the latching element 72 in the edge section which lies in the plugging direction $S_2$.

The actuation part 80 is likewise formed of plastic as an injection molded part. It has the shape of a sleeve which, lying at least partly in close contact, receives the latching element 72 and the housing cap 78. A front housing collar 118 in the plugging direction $S_2$ has smooth walls and a cross-section such that it can be introduced in a shape matched manner into the first housing 24 and in particular into its receiving groove 56. Guide passages 122 are formed in a rear handle section 120 when viewed in the plugging direction $S_2$ which extend symmetrically parallel to the plugging direction $S_2$ at oppositely disposed flat sides, which are open at the end side opposite to the plugging direction $S_2$ and in which the support elements 98, the housing support elements 100 and the abutment elements 114 can be guided.

Furthermore, the actuation part 80, which is not shown in the Figures, has securing elements which are complementary to the securing elements 108, so that the actuation part 80 is held and guided displaceably at the housing cap 78.

To assemble the second plug connector, the cables 84 are first crimped to the contact elements 82. The contact elements 82 are then pushed into the second contact element receiver 64, which is manufactured by injection molding, and are latched there in a known manner.

In a following step, the two screen parts 68 and 70 are pushed transversely to the plugging direction $S_2$ over the second contact element receiver 64, with the second tongues 90 engaging below the L-shaped section 92 and edge sections of the indented regions 94 engaging into the first screen part 68. In this process, the first tongues 88 snap into the apertures 96 and close them off. The contact element receiver 64 is now completely surrounded by the screen 66 with the exception of its end faces, since the apertures 96 are covered over by the first tongues 88. Furthermore, the contact element receiver 64 is no longer displaceable with respect to the screen 66, since the blocking projections 86 engage into the L-shaped section 92, which acts as a blocking element.

Furthermore, the band clamp fitting 100 is bent over the exposed screen of the lead 16 and contacted to it (cf. FIG. 8).

The exposed indented regions 94 now form indentations 124 at oppositely disposed sides. At their end sides which lie in the plugging direction $S_2$, the shoulders which border the indentations 124 form in each case a securing projection 126 as securing elements which are complementary to the securing elements or snap hooks 46.

In a next step, the upper part 102 and the lower part 104 of the housing cap 78 are plugged together, with the lead 16 being gripped about by the cuff sections, which form the cuff 106. An injection molding of the lead 16 is not necessary.

The unit consisting of the second contact element receiver 64 and the second screen 66 is now pushed into the housing cap 78. Furthermore, the latching element 72 is pushed onto the screen 66, so that the resilient elements 74, which are held with one end at the abutment elements 114, come to lie with their other ends at the support elements 98 (cf. FIG. 9).

In a following step, the actuation part 80 is pushed onto the thus created unit and is latched to the housing cap 78, so that the second plug connector 14 which is shown in FIG. 1 arises.

The processes during the establishment and releasing of a plug connection between the first and second plug connectors 10 and 14 respectively will now be explained with reference to FIGS. 10 to 15. First the second plug connector is introduced with the actuation part 80 into the first housing 24, with an unintentional rotation being excluded by the non-symmetrical shaping of the inner cross-section of the housing 24 and of the corresponding outer cross-section of the actuation part 80 and of the housing collar 118.

The housing collar 118 is designed such that it can be received in a substantially shape matched manner into the receiving groove 56 in the housing 24.

As shown in FIG. 10, the plugging ends 32 of the contact pins 20 are introduced into the contact elements 82 in the second contact element receiver 64, with the snap hooks 46, which are only incompletely and schematically reproduced in FIGS. 10 to 15, at the same time being resiliently bent apart and thus tensioned by the second screen 66, favored by edges at the end face of the second screen 66 which are bent over towards one another. They abut the end side of the latching element 72 and push the latching element 72, which surrounds the screen 66 and is guided into the guide passage 118 with the abutment element 114, out of a latching position, in which it covers the indentations 124 and the securing projections 126, opposite to the plugging direction $S_1$ in the direction towards the housing cap 78. The resilient elements 84 are supported at the support elements 98 of the second screen 66.

On a further pushing in, the latching element 72 at least partly releases the securing projections 126 and exposes the indentation 124, so that the snap hooks 46 can snap in behind the securing projections 126 into the indentations 124 in a securing position (cf. FIG. 11). The latching element 72 has then reached the unlatching position.

As shown in FIG. 12, after snapping into the indentations 124, the snap hooks 46 no longer block the latching element 72, so that it is moved by the resilient elements 74, which were tensioned relative to the second screen 66 by the movement of the latching element 72, over and beyond the snap hooks 46 into its latching position, in which the indentations 124 are now covered by the securing projections 126 and the snap hooks 46. Thus a movement of the snap hook 46 in a direction which is orthogonal to the plugging direction $S_1$ or $S_2$ respectively, which also means over and beyond the securing projections 126, is no longer possible. The first and second plug connectors 10 and 14 respectively are now secured in the plugged together position, since the snap hooks 46 engage behind the securing projections 126 and thus prevent a moving apart of the two plug connectors parallel to the plugging direction.

In the completely plugged together state (cf. FIG. 13), the housing collar 118 is introduced as far as possible into the receiving groove 56 in the first housing 24, with the handle section 120 abutting the end face of the first housing 24 in its connection position and thus preventing a further movement in the plugging together direction. Furthermore, the region in which the contact elements are plugged together is completely surrounded and thus protected by the plugged together housings.

In the plugged together state in FIG. 13, a very good contact continues to be achieved by the contact between the first and second screens 22 and 66 and in particular by the lying of the snap hooks or latching hooks 46 in contact with the second screen 66 in the indentation 124. The entire region of the contact elements up to the lead 16 continues to be completely screened.

To release the plug connector, the actuation part 80 is moved in the direction toward the housing cap 78 into an open position by an opening movement opposite to the plugging direction $S_2$, with the abutment elements 114 guided in the guide passages 122 being co-moved, acting as co-moving abutments 128, as complementary abutments by end face walls 130 of the guide passages 122 which lie in the plugging direction $S_2$. The latching element 72 is hereby moved out of the latching position into the unlatching position. For this purpose, a force predetermined by the resilient elements 74, that is, by their spring constants, is required, so that an unintentional movement of the actuation part 80 can be largely excluded by the predetermination of corresponding forces or spring constants respectively of the resilient elements 74.

By this movement of the latching element 72 out of the latching position into the unlatching position, the indentation 124 and in particular the securing projections 126 and the snap hooks 46 are partly released, so that they can be moved in a direction which is transverse to the plugging direction. The length or the latching position respectively of the latching element 72 is chosen such that the actuation part 80 must first be moved over a predetermined distance, in the example approximately 6 mm, until the unlatching position is reached. It is thus excluded, on the one hand, that an unlatching can already take place in the event of a short, accidental movement of the actuation part 80. On the other hand, in conjunction with the spring constants of the preferably like designed resilient elements 74, the minimum force for the unlatching which is required in order to effect an unlatching can be set in a simple manner.

In a further pulling on the actuation part 80, the housing cap 78 with the second screen 66 and the second contact element receiver 64 received therein is moved out of the first plug connector 10, that is, the appliance receiver, via the resilient elements 74 or via a corresponding abutment, for example on the screen 66 or the housing cap 78. The snap hooks 46 of the first screen 22 are drawn over the securing projections 126 and spread apart by the application of a corresponding force, for which purpose the corresponding hook-like sections are bent substantially in V-shape, so that the securing projections 126 are guided on the corresponding limbs of the hook-like sections. The snap hooks 46 now no longer hinder the further drawing apart, so that the plug connectors can be completely separated.

What is claimed is:

1. Plug connector for plugging together with a complementary plug connector in a plugging direction-comprising:

a contact element receiver for receiving a contact element, a screen that at least partly surrounds the contact element receiver, and a housing that at least partly accommodates the contact element receiver and the screen;

wherein the screen has at least one securing element, which, when the plug connector is plugged together with the complementary plug connector, can be moved relative to a complementary securing element of the complementary plug connector into a securing position relative to the complementary securing element and by means of said securing element, and wherein a relative movement of the plug connectors out of the plugged together position can be limited in the securing position through cooperation with the complementary securing element;

a latching element which is movable relative to the contact element receiver between an unlatched position and a latched position, with the securing elements of the plug connector and of the complementary plug connector being movable from an upper surface of the screen into and/or out of the securing position in the unlatched position of the latching element and with the latching element in the latched position latching the securing elements in their securing position against a movement out of the securing position.

2. Plug connector in accordance with claim 1, wherein the housing comprises at least two housing parts.

3. Plug connector in accordance with claim 1, wherein the housing is formed in one piece and comprises a sleeve-like sections into which the screen with the contact element receiver is inserted.

4. Plug connector in accordance with claim 1, wherein the screen comprises at least two screen parts that can be pushed together transversely to the plugging direction and that are formed as bent, stamped parts.

5. Plug connector in accordance with claim 4, wherein the contact element receiver and the screen have cooperating blocking elements that extend transversely to the plugging direction and that block a relative movement between the contact element receiver and the screen in and/or opposite to the plugging direction.

6. Plug connector in accordance with claim 1, wherein the screen is formed in one piece as a bent, stamped part.

7. Plug connector in accordance with claim 1, wherein the screen has a bent over wing that is angled with respect to the plugging direction and that at least partly closes off a push in opening in the screen, through which the contact element receiver can be inserted.

8. Plug connector in accordance with claim 1, wherein the plug connector includes contacts for connection to a circuit carrier formed at opposite sides of the screen.

9. Plug connector in accordance with claim 1, wherein the screen has two securing elements, which are formed at opposite sides of the screen.

10. Plug connector in accordance with claim 1 wherein the securing element has a resilient snap hook or latching hook which is formed in a collar which is formed by the screen.

11. Plug connector in accordance with claim 1, wherein the securing element has a securing projection which a hook of the complementary plug connector, which is plugged together with the plug connector, engages in the securing position.

12. Plug connector in accordance with claim 1, wherein the latching element is displaceable parallel to the plugging direction relative to the screen and at least partly surrounds the screen in a sleeve-like manner.

13. Plug connector in accordance with claim 1, further comprising a resilient element which can be urged into the unlatched position through movement of the latching element relative to the plug connector the latching element being movable into the latched position by means of the restoring force of the resilient element.

14. Plug connector in accordance with claim 1, wherein the latching element can be moved from the latched position into the unlatched position through an opening movement of an actuation part of the housing out of a connection position in which the plug connector is plugged to a complementary plug connector into an opening position relative to the contact element receiver.

15. Plug connector in accordance with claim 14, wherein the latching element has a co-moved abutment which lies in contact with a complementary abutment of the actuation part at least during a part of the opening movement of the actuation part.

16. Plug connector in accordance with claim 1, wherein the plug connector is formed for plugging together with a complementary plug connector;

and wherein the latching element is spaced from the screen such that a circumferential collar of the complementary plug connector can at least partly be accommodated between the latching element and the screen.

17. Plug connector in accordance with claim 1, wherein contact elements which can be or are fitted onto cables are arranged in the contact element receiver.

* * * * *